US006162087A

United States Patent [19]

Hiura

[11] Patent Number: 6,162,087

[45] Date of Patent: Dec. 19, 2000

[54] BOOT

[75] Inventor: Yasuhiro Hiura, Yokkaichi, Japan

[73] Assignee: Sumitomo Wiring Systems, Ltd., Japan

[21] Appl. No.: 09/060,824

[22] Filed: Apr. 16, 1998

[30] Foreign Application Priority Data

Apr. 18, 1997 [JP] Japan ..... 9-102061

[51] Int. Cl.[7] ..... H01R 13/52

[52] U.S. Cl. ..... 439/521; 174/152 G

[58] Field of Search ..... 174/152 G, 153 G, 174/65 R; 439/447, 521

[56] References Cited

U.S. PATENT DOCUMENTS

| | | | |
|---|---|---|---|
| 3,120,987 | 2/1964 | Degnan et al. . | |
| 3,518,600 | 6/1970 | Urani | 439/447 X |
| 5,037,326 | 8/1991 | Reedy | 174/153 G |
| 5,138,117 | 8/1992 | Oikawa et al. | 174/152 G |
| 5,279,507 | 1/1994 | Kameyama . | |
| 5,300,734 | 4/1994 | Suzuki . | |
| 5,448,017 | 9/1995 | Nakajima et al. | 174/152 G |

FOREIGN PATENT DOCUMENTS

| | | |
|---|---|---|
| 0 323 064 | 7/1989 | European Pat. Off. . |
| 372361 | 11/1963 | Switzerland . |
| 2 202 692 | 9/1988 | United Kingdom . |

OTHER PUBLICATIONS

European Search Report EP 98 30 2716, dated Jul. 19, 1999.

*Primary Examiner*—Khiem Nguyen
*Attorney, Agent, or Firm*—Banner & Witcoff, Ltd.

[57] ABSTRACT

Anti-skid protrusions 26 and 27 are formed on the inside of a rubber boot 20 which fits on the smooth external surface of an electrical connector housing 10. Since the connector housing 10 has no molded supports for the boot, production cost is reduced.

13 Claims, 5 Drawing Sheets

BOOT

TECHNICAL FIELD

The present invention relates to a waterproofing boot adapted to cover protruding wires of an electrical connector.

BACKGROUND TO THE INVENTION

In waterproof connectors, waterproofing is effected by attaching an elastomeric boot to the rear face of the connector from which an electric wire of a connector housing protrudes, this boot covering the protruding portion of the electric wire. A tubular sleeve of the boot fits tightly to the external periphery of the connector housing by stretching in a resilient manner, waterproofing being effected due to the force of this tight fitting.

In the waterproofing configuration described above, it has been necessary to provide a means whereby the boot and the connector housing are maintained in a fitted state. In the case where mutually fitting concave-convex shapes are provided on the external periphery of the connector housing and on the fitting portion of the rubber boot, although a highly effective support is achieved, the configuration becomes more complex and the cost of parts increases.

In contrast, in the case where no special stopping configuration is provided, and the supporting force is exerted merely by the resilience of the boot, although the cost of production decreases, the reliability of the supporting function also decreases.

The present invention has been developed after taking the above circumstances into consideration, and aims to provide a means whereby cost is kept low and the supporting function is effected reliably.

SUMMARY OF THE INVENTION

According to a first aspect of the invention there is provided in combination, an electrical connector and an elastomeric boot therefor, the connector comprising a body having an external peripheral portion over which a mouth of the boot is resiliently engaged to cloak part of the body characterised in that said peripheral portion is smooth, the boot having an internal anti-skid protrusion for resilient engagement with said peripheral portion, said protrusion being continuous and adjacent the mouth of said boot.

Such a boot has the advantage that corresponding concave or convex locking forms for the boot are not required on the outer surface of the connector body; moulding is therefore facilitated.

The protrusions may be at the mouth of the boot and spaced internally thereof. This arrangement gives improved gripping and is especially useful where the boot is not straight.

In a preferred embodiment a portion of the body enclosed by the boot is reduced in size giving a stepped external profile. The boot has protrusions engageable on the main body, and on the projecting portion. This combination is especially able to resist pulling on an 'L' shaped boot, particularly in cases where a strut is moulded across the internal angle of the boot to prevent straightening thereof. In cases where a wire protrudes from the free end of such a boot, a tape may be applied to seal the boot to the wire, and such tape may also be wrapped around the adjacent portion of the strut to improve stiffness of the boot.

The tape may be wrapped around a portion of a moulded strut in order to further stiffen an 'L' shaped boot against deformation.

The protrusions are preferably continuous adjacent the mouth of the boot, and may be angled inwardly to improve ease of attachment, and to resist removal.

According to a second aspect of the invention there is provided a boot for shielding a wire protruding from an electrical connector, said boot being substantially 'L' shaped and having a first open limb for engagement over a housing of an electrical connector and a second open limb to allow passage of an electrical wire from said connector through said boot to the exterior, wherein said boot includes a stiffening strut extending from said first limb to an area closely adjacent to the mouth of said second limb.

Such a long strut allows deformation of the second limb for the purposes of introducing a wire therethrough, but also permits deformation of the strut under taping to shorten the length thereof, and thereby stiffen the boot. This is advantageous as compared with a short strut terminating at some distance from the mouth of the second limb which, whilst somewhat stiffer, has the disadvantage of making it difficult to introduce the wire.

According to a third aspect of the invention there is provided a boot for shielding a wire protruding from an electrical connector, said boot being substantially 'L' shaped and having a first open limb for engagement over a housing of an electrical connector, the mouth of said first limb having a protrusion on the inside thereof for engagement with said housing, wherein said protrusion is spaced from said mouth and is adapted to extend on the side of said housing opposite to the second limb of said boot.

Such a protrusion is effective in resisting said boot being pulled off a housing if said second limb is bent down in use by pulling on the wire protruding therefrom. Preferably said protrusion comprises an upstanding wall; in the case where the connector housing is rectangular the wall may extend around the side of the housing opposite to said second limb, and around the sides adjacent the opposite side.

In a preferred embodiment the open mouth of said first limb is resiliently engageable on the periphery of a housing of an electrical connector, and said protrusion is engageable with an inwardly stepped wall of said housing.

BRIEF DESCRIPTION OF DRAWINGS

Other features of the invention will be apparent from the following description of several preferred embodiments illustrated by way of example only in the accompanying drawings in which.

DESCRIPTION OF PREFERRED EMBODIMENTS

Figure 1:
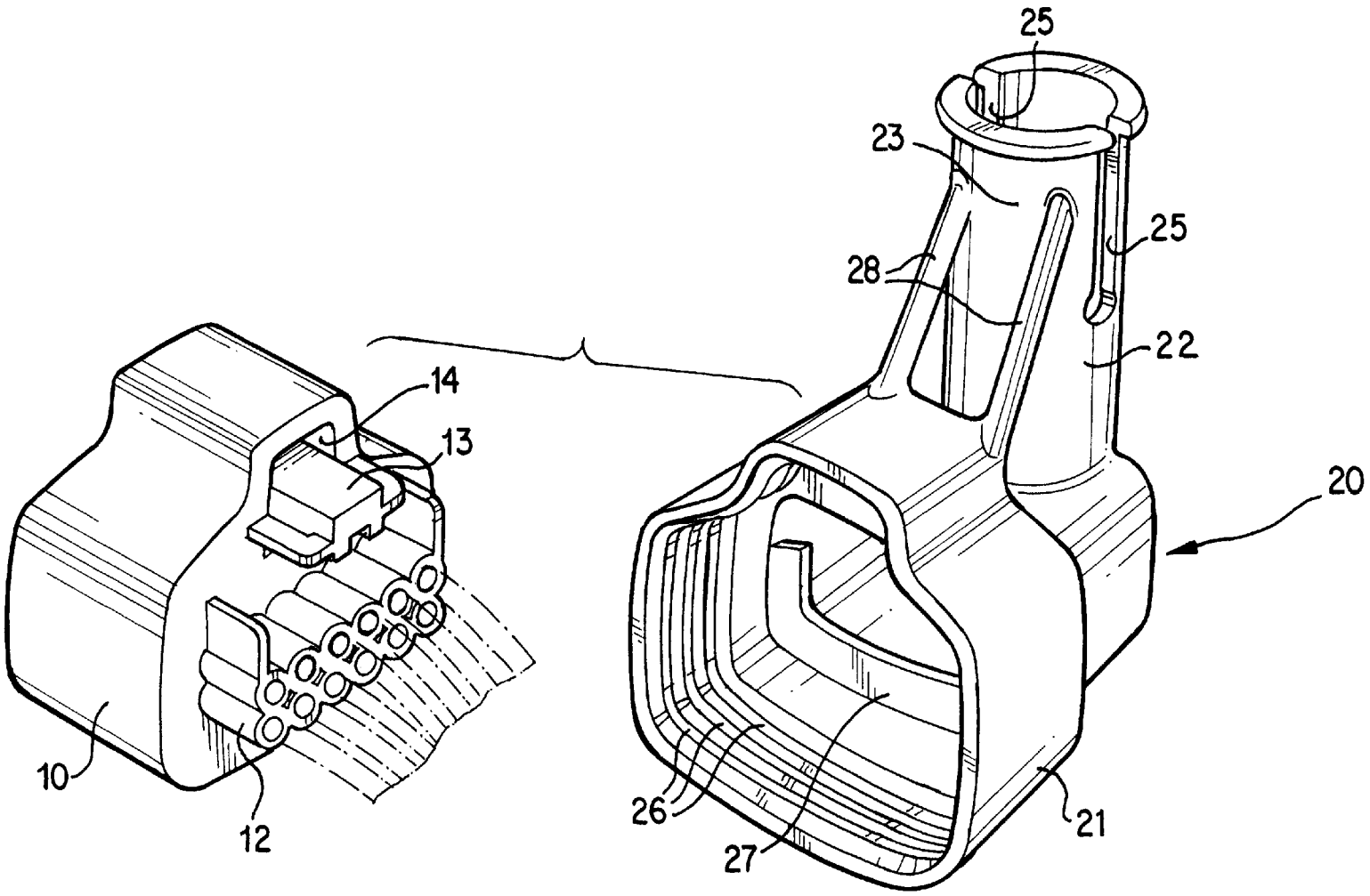
FIG. 1 is a diagonal view of a first embodiment showing a rubber boot separated from a connector housing.
Figure 2:
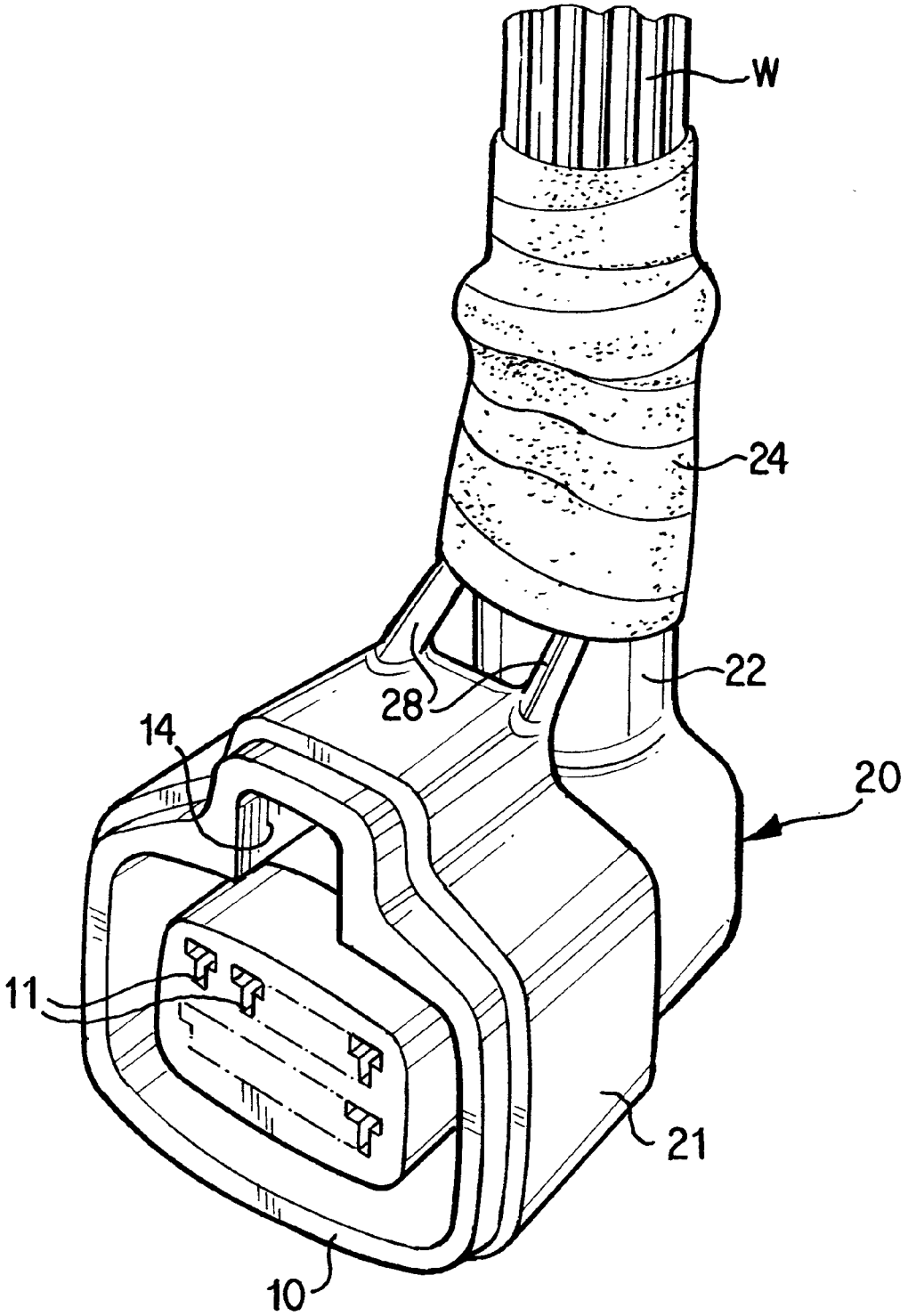
FIG. 2 is a diagonal view of the first embodiment showing the boot fitted to the connector housing.

A first embodiment of the present invention is explained below with the aid of FIGS. 1 to 6.

A connector housing 10, to which a boot 20 of the present embodiment is fixed, is described first. The connector housing 10 is made from synthetic resin, and its interior has a plurality of cavities 11 formed therein, a female terminal fitting (not shown) being inserted from the posterior end of each cavity 11. The rear face of the connector housing 10 has a plurality of tubular extending members 12 that connect with each cavity 11, electric wires W crimped to each female terminal fitting protruding from these tubular extending members 12. The external peripheral face of the connector housing 10 is plain and smooth, and thus has no concave or convex formations; the boot 20 is fitted to this external peripheral face. Furthermore, the central portion of the upper face protrudes, describing a smooth arc shape, this protrusion forming a housing 14 for a locking arm 13.

The boot 20 comprises an elastomeric tubular shaped fitting portion 21 that fits on the external peripheral face of the connector housing 10, and a tubular electric wire passage member 22 that connects with the posterior end of the fitting portion 21 and has an L-shape.

The fitting portion 21 has the same shape as the external periphery of the connector housing 10, but is somewhat smaller. Consequently, the fitting portion 21 is stretched in a resilient manner to cloak the housing.

The tubular extending members 12 of the connector housing 10 are inserted into the portion connecting the electric wire passage member 22 and the fitting portion 21, the electric wires W protruding from the connector housing 10 being bundled together and passed through the L-shaped passage in order to protrude from the outer end of the member 22.

The upper part of the passage member 22 forms a taping member 23, a fixing tape 24 being wound around the external periphery of this taping member 23 and the protruding wire portion.

Left and right slits 25 are formed in the taping member 23 from its outer end downwards, as shown. This allows the taping member 23 to expand or to contract depending on the number of electric wires W (that is, depending on the thickness of the wire bundle). In this manner, the taping member 23 can envelope the wire bundle closely.

Anti-skid protrusions 26 and 27 are formed on the inner peripheral face of the fitting portion 21 (the face corresponding to the external peripheral face of the connector housing 10), the anti-skid protrusions 26 being located at a position closer to the open end of the fitting portion 21.

Figure 5:
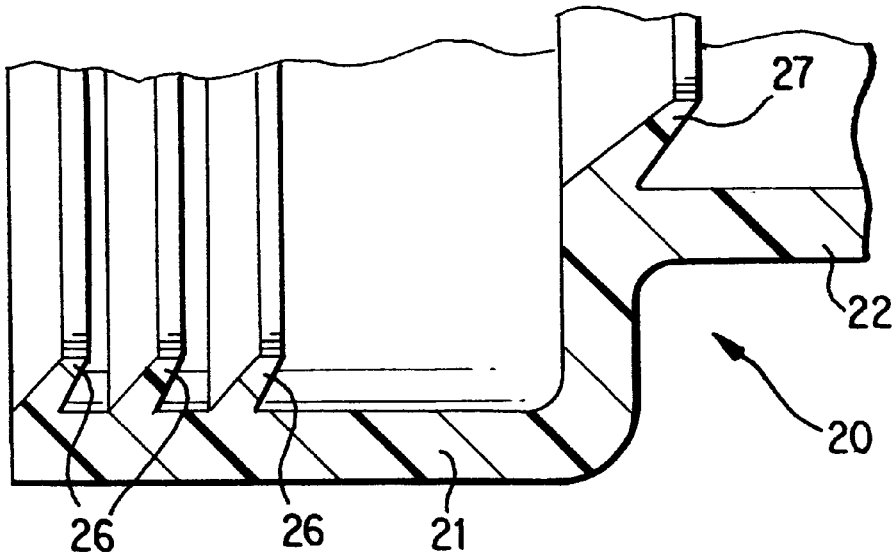
FIG. 5 is a partially enlarged cross-sectional view of the boot of the first embodiment 1.
Figure 6:
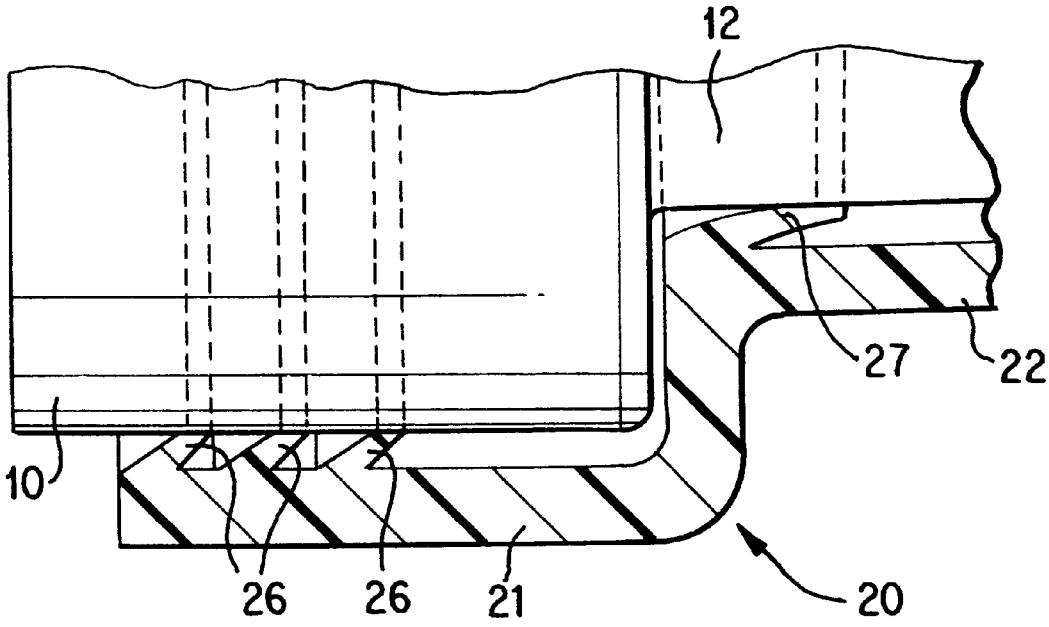
FIG. 6 is a partially enlarged cross-sectional view of the boot of the first embodiment when attached to a connector housing.

The anti-skid protrusions 26, extend around the entire inner peripheral face of the fitting portion 21, and consist of a plurality of linear barbs that are located at a fixed pitch in the axial direction (in the present embodiment three anti-skid protrusions 26 are shown). As shown in the enlarged view of FIG. 5, the cross-sectional face of each barb has a wedge shape and is inclined in a direction opposite to the fitting direction of the boot 20. The anti-skid protrusion 27 is located far from the open end of the fitting portion 21 at the boundary of the electric wire passage member 22 and the fitting portion 21, in the region corresponding to the lower, and the left and right side faces of the tubular extending members 12. As shown in FIG. 5, the cross-sectional face of the anti-skid protrusion 27 also has a wedge shape and is inclined in a direction opposite to the direction of fitting of the rubber boot 20. Furthermore, anti-skid protrusion 27 protrudes more than the anti-skid protrusions 26.

Left and right strengthening stays 28 are formed between the posterior end of the upper face of the fitting portion 21 and the location close to the upper end of the taping member 23. These strengthening stays 28 extend in a diagonal manner with respect to the path taken by the wires in the passage member 22, and resist an external force tending to straighten the passage member 22.

Next, the operation of the present embodiment is described.

When the boot 20 is to be attached to the connector housing 10, before the female terminal fitting is inserted into the connector housing 10, the electric wires W are passed through the electric wire passage member 22 and the fitting portion 21 of the rubber boot 20. Each female terminal fitting is then inserted into the connector housing.

Next, the rubber boot 20 is attached to the connector housing 10 from its rear side. The fitting portion 21 is stretched and is fitted over the external peripheral face of the connector housing 10. Along with this, the anterior end of the electric wire passage member 22 fits with the tubular extending members 12. As shown in the enlarged diagram in FIG. 6, simultaneously the anti-skid protrusions 26 located close to the open end of the fitting portion 21 bend down in a resilient manner away from the external peripheral face of the connector housing 10 and fit tightly therewith. The anti-skid protrusion 27 located further away from the open end bends down diagonally in a resilient manner away from the side faces and the lower face of the tubular extending members 12 and fits tightly therewith.

In this state, the space between the connector housing 10 and the boot 20 is waterproof due to tight fitting of the continuous anti-skid protrusions 26. An external force tending to separate the boot 20 from the connector housing 10 is resisted due to frictional resistance produced by the tightly fitting protrusions 26.

The angle of the anti-skid protrusions 26 increases the resistance to removal and thus the protrusions 26 provide a highly reliable supporting function.

The anti-skid protrusion 27 bends downwards, making tight contact in a resilient manner with the lower and side faces of the tubular extending members 12, removal of the rubber boot 20 being resisted by the frictional resistance produced by the recovery force due to the resilience of the anti-skid protrusion 27.

Furthermore, in the case where the electric wire passage member 22 is pulled in the upward direction, although such a pulling force applies strongly to the lower face of the rubber boot 20, in the present embodiment, in accompaniment with the application of this pulling force, the tightening force of the anti-skid protrusion 27 with respect to the tubular extending member 12 increases, resulting such pulling force being resisted exclusively by the anti-skid protrusion 27. In consequence there is a reduction of the application of the pulling force on the lower faces of the anti-skid protrusions 26 located towards the open end, and the removal preventing function of the anti-skid protrusions 26 located near the open end is not adversely affected.

Figure 4:
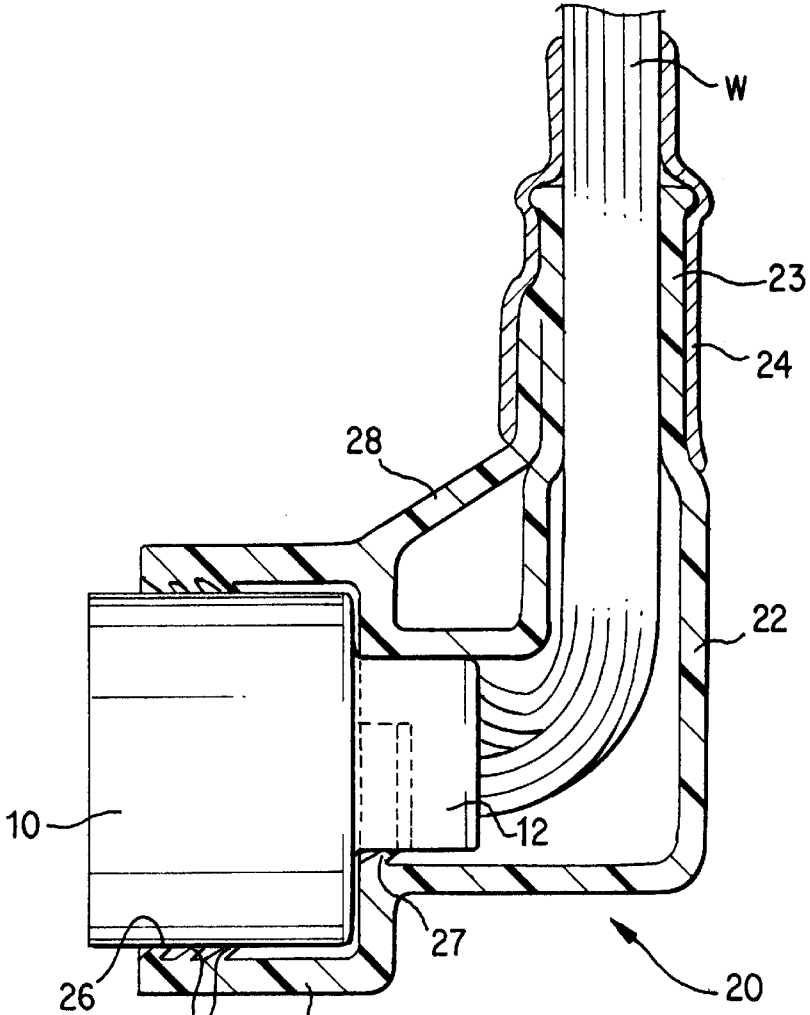
FIG. 4 is a cross-sectional view of the first embodiment showing the boot fitted to the connector housing.
Figure 3:
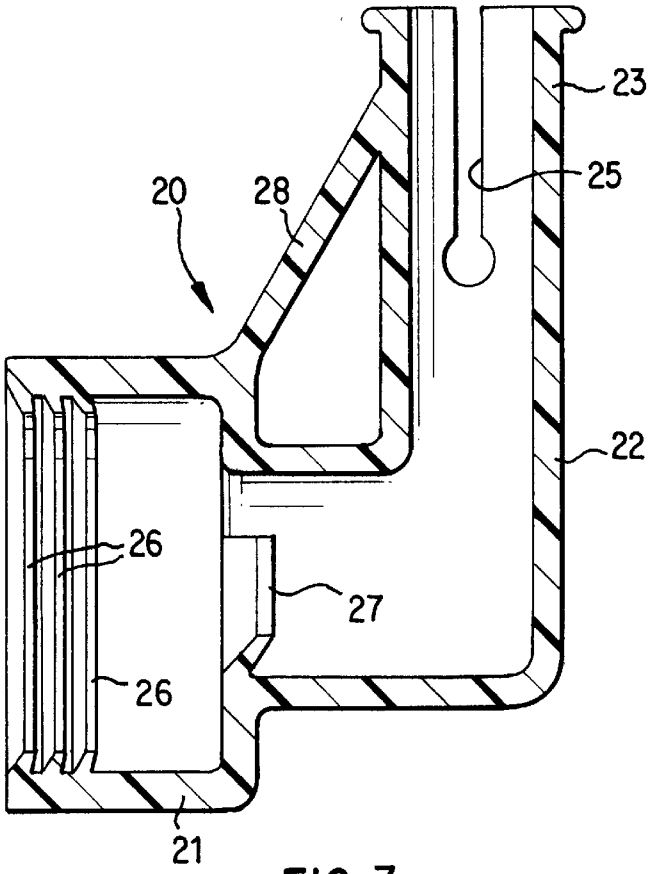
FIG. 3 is a cross-sectional view of the boot of the first embodiment.

After attaching the rubber boot 20 in the manner described, the tape 24 is wound around the taping member 23, and the electric wires W and the electric wire passage member 22 are fixed together. As shown in FIG. 4, the tape 24 is also wound around the upper portions of the strengthening stays 28. In this manner, the attachment is the rubber boot 20 is completed.

In this state, the relatively long stays 28 are shortened, and thus improves the stiffness of the boot, and thus the resistance to bending. However in the free state the long stays 28 permit relatively easy bending of the outer limb of the boot to facilitate entry of the wire bundle. Consequently, there is a reduced possibility of the passage member 22 changing shape so as to allow the pulling force to act on the main axis of the connector housing 10, and thus remove the boot.

Furthermore, even in the case where the tape 24 is wound only around the portion that is located above the strengthening stays 28, stays 28 nevertheless resist such bending. Consequently, a straightening of the passage member 22 is prevented with certainty.

As described above, in the present embodiment, since the configuration is such that the rubber boot 20 has anti-skid protrusions 26 and 27 and the connector housing 10 has no supporting means, the cost of production is reduced and yet the rubber boot 20 is maintained with certainty in the fitted state.

Figure 7:
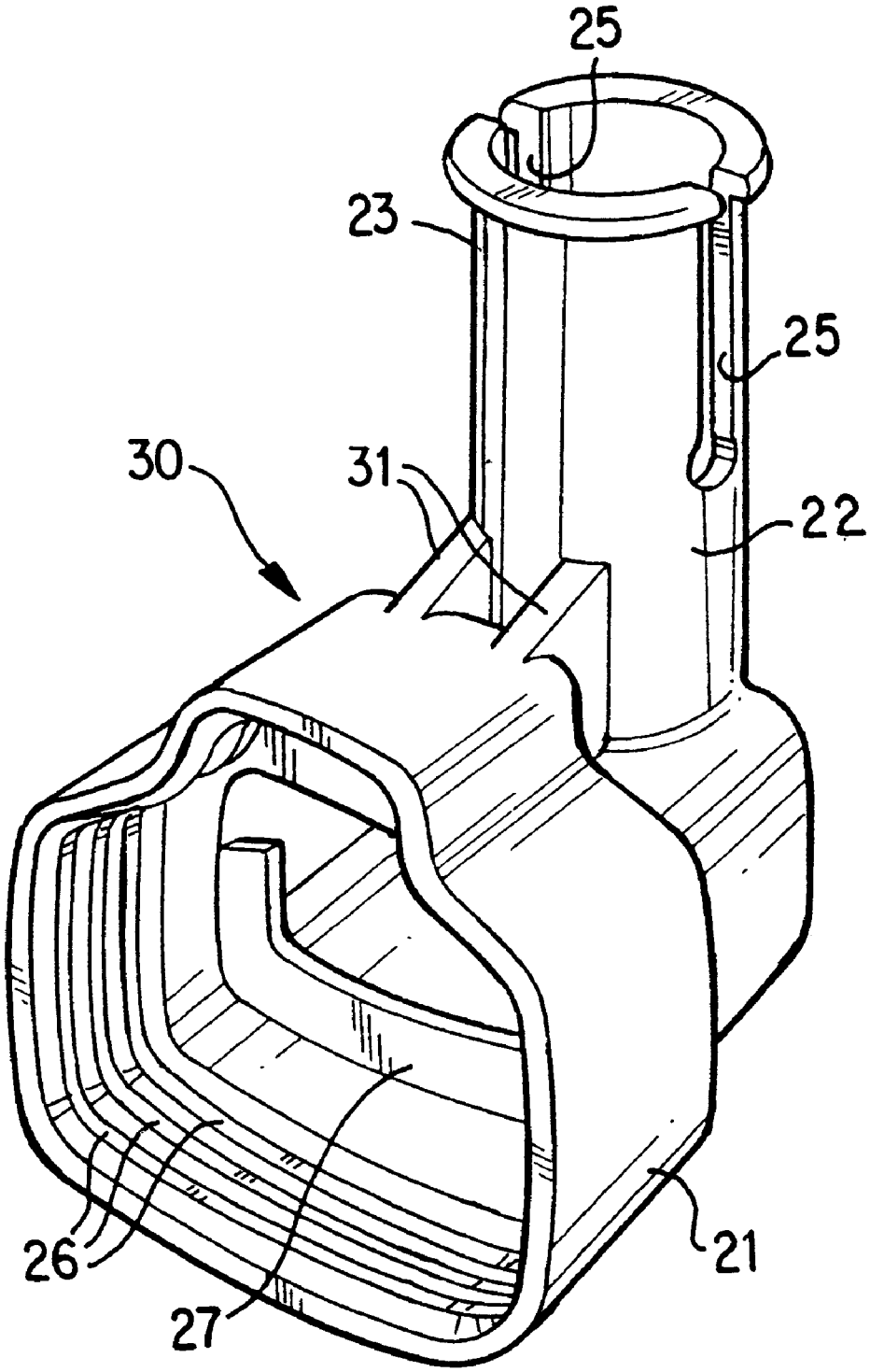
FIG. 7 is a diagonal view of a boot according to a second embodiment.

A second embodiment of the present invention is explained below with the aid of FIG. 7.

The second embodiment differs from the first embodiment in that the configuration for the means for preventing change of shape of the electric wire passage member is different. Since the configuration of the rest of the embodiment is the same as that of first embodiment, the same numerals are accorded to corresponding parts and an explanation of the configuration, operation and effects thereof is omitted.

A rubber boot 30 of the second embodiment 2 has a pair of left and right strengthening ribs 31 that replace the strengthening stays 28. The strengthening ribs 31 are formed in a uniform manner along the inner area of the bent portion on the external periphery of an electric wire passage member 22. The strengthening ribs 31 are wall like and extend from a position below slits 25 of the electric wire passage member 22 up to the posterior end of a fitting portion 21.

The supporting ribs 31 provide resistance against an external force tending to straighten the electric wire passage member 22. Consequently, a recovery force of the electric wires W (not shown in FIG. 7) or an external force applied on the electric wires W so as to straighten them, can at most bend the upper taping member 23. There is no change of shape in the lower area of the electric wire passage member 22 and thus separation of the rubber boot 30 from the connector housing 10 (not shown in FIG. 7) due to change of shape of the fitting portion 21 is prevented.

The present invention is not limited to the embodiments described above with the aid of figures. For example, the possibilities described below also lie within the technical range of the present invention. In addition, the present invention may be embodied in various other ways without deviating from the scope thereof.

(1) The anti-skid protrusions may be exclusively provided either in the location closer to the open end of the fitting portion or in a location further away from the open end of the fitting portion.

(2) The invention is not limited to an L-shaped boot described in the above embodiments, but can also be applied to a boot that allows electric wires to pass through in a straight line.

(3) It may equally be arranged that the anti-skid protrusions located further away from the open end extend around the entire periphery.

What is claimed is:

1. In combination, an electrical connector and a tubular elastomeric boot therefor, the connector comprising a body having a smooth external peripheral portion over which a mouth of the boot is resiliently engaged to cloak part of the body, said boot also having a first internal anti-skid protrusion extending inward a first distance away from an inner surface thereof for resilient engagement with said smooth peripheral portion of the body received within the boot, said protrusion being continuous and adjacent the mouth of said boot, and a second anti-skid protrusion extending inward a second distance away from an inner surface of said boot for resilient engagement with said connector, wherein said second distance is greater than said first distance.

2. The combination of claim 1 wherein each of said first and second protrusions inclines in a direction away from the mouth of said boot.

3. The combination of claim 1 wherein said boot includes a plurality of said first protrusions.

4. The combination of claim 2 wherein said boot includes a plurality of said first protrusions.

5. The combination of claim 3 wherein said second protrusion is spaced inwardly from said mouth and said first protrusions.

6. The combination of claim 4 wherein said second protrusion is spaced inwardly from said mouth and said first protrusions.

7. The combination of claim 5 wherein said second protrusion is linear and extends around only a part of said connector.

8. The combination of claim 5 wherein said boot is tubular, substantially 'L' shaped and adapted to house an electrical lead of the connector, and said second protrusion is finite and extends on a side of the boot opposite to a free end thereof.

9. The combination of claim 8 wherein said body is rectangular and said second protrusion comprises a wall extending along the side of the boot opposite the free end thereof, said wall also extending partially up adjacent sides of the body.

10. The combination of claim 8 wherein the boot includes first and second arms extending at an angle to each other and a reinforcing strut extending between the arms so as to resist opening of the angle.

11. The combination of claim 9 wherein the boot includes first and second arms extending at an angle to each other and a reinforcing strut extending between the arms so as to resist opening of the angle.

12. The combination of claim 5 wherein said boot is tubular, substantially 'L' shaped with first and second arms extending at an angle to each other and adapted to house an electrical lead of the connector, and a reinforcing strut extends between the arms so as to resist opening of the angle.

13. A tubular boot for shielding a wire protruding from an electrical connector, said boot being substantially 'L' shaped and having a first open limb for engagement over a housing of an electrical connector and a second open limb to allow passage of an electrical wire from said connector through said boot to the exterior, wherein said boot includes a stiffening strut extending at an angle from said first limb to an area closely adjacent to a mouth of said second limb to interconnect the first and second limbs.

* * * * *